US009636545B2

(12) United States Patent
Farrell et al.

(10) Patent No.: US 9,636,545 B2
(45) Date of Patent: May 2, 2017

(54) LOW COMPRESSION GOLF BALL

(71) Applicant: Acushnet Company, Fairhaven, MA (US)

(72) Inventors: John D. Farrell, Providence, RI (US); Brian Comeau, Berkley, MA (US); Douglas S. Goguen, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/577,035

(22) Filed: Dec. 19, 2014

(65) Prior Publication Data

US 2015/0367179 A1 Dec. 24, 2015

Related U.S. Application Data

(63) Continuation-in-part of application No. 14/307,827, filed on Jun. 18, 2014.

(51) Int. Cl.
*A63B 37/02* (2006.01)
*A63B 37/00* (2006.01)

(52) U.S. Cl.
CPC ..... *A63B 37/0075* (2013.01); *A63B 37/0023* (2013.01); *A63B 37/0031* (2013.01); *A63B 37/0043* (2013.01); *A63B 37/0046* (2013.01); *A63B 37/0062* (2013.01); *A63B 37/0063* (2013.01); *A63B 37/0065* (2013.01); *A63B 2037/0079* (2013.01)

(58) Field of Classification Search
CPC ..... A63B 37/0065; A63B 37/0063; A63B 2037/0079
See application file for complete search history.

(56) References Cited

U.S. PATENT DOCUMENTS

| | | | | |
|---|---|---|---|---|
| 6,417,278 | B1 | 7/2002 | Ladd et al. | |
| 6,998,445 | B2 | 2/2006 | Ladd et al. | |
| 7,429,221 | B1 * | 9/2008 | Bulpett | A63B 37/0003 473/376 |
| 7,431,669 | B2 | 10/2008 | Lemons et al. | |
| 7,918,748 | B2 | 4/2011 | Ogg et al. | |
| 2001/0044346 | A1 * | 11/2001 | Yoshida | A63B 37/0003 473/371 |
| 2004/0058750 | A1 * | 3/2004 | Iwami | A63B 37/0003 473/371 |
| 2009/0011864 | A1 * | 1/2009 | Ladd | A63B 37/0062 473/376 |
| 2010/0227707 | A1 * | 9/2010 | Sullivan | A63B 37/0062 473/374 |
| 2010/0331110 | A1 * | 12/2010 | Hebert | A63B 37/0003 473/373 |
| 2011/0003650 | A1 * | 1/2011 | Comeau | A63B 37/0061 473/373 |
| 2011/0224022 | A1 * | 9/2011 | Sullivan | A63B 37/0003 473/376 |

* cited by examiner

*Primary Examiner* — John E Simms, Jr.
(74) *Attorney, Agent, or Firm* — Mandi B. Milbank

(57) ABSTRACT

Disclosed herein are two-layer and three-layer, low compression golf balls including a low compression single- or dual-layer rubber core and a single cover layer.

6 Claims, No Drawings

LOW COMPRESSION GOLF BALL

CROSS-REFERENCE TO RELATED APPLICATIONS

The present application is a continuation-in-part of U.S. patent application Ser. No. 14/307,827, filed Jun. 18, 2014, the entire disclosure of which is hereby incorporated herein by reference.

FIELD OF THE INVENTION

The present invention generally relates to golf balls, and more particularly to two-layer and three-layer golf balls having a low compression core.

BACKGROUND OF THE INVENTION

U.S. Pat. No. 7,431,669 to Lemons et al. discloses a golf ball having a core with a low compression and at least two additional layers.

U.S. Pat. No. 7,918,748 to Ogg et al. discloses a golf ball having a core compression of from 20 to 45 and a ball compression of from 35 to 50. The core includes a single neodymium-catalyzed polybutadiene.

The present invention provides a novel golf ball construction including a low compression core and a cover, and resulting in a soft, low overall compression golf ball. In some embodiments, golf balls having the novel construction disclosed herein provide increased distance and improved feel while maintaining durability, particularly at low swing speeds.

SUMMARY OF THE INVENTION

In one embodiment, the present invention is directed to a two-layer golf ball having a compression of from 25 to 55 and consisting essentially of a core and a cover layer. The core has a compression of less than 20 and is formed from a polybutadiene blend composition comprising a first polybutadiene and a second polybutadiene. The cover layer is formed from a thermoplastic composition.

In another embodiment, the present invention is directed to a two-layer golf ball having a compression of from 25 to 55 and consisting essentially of a core and a cover layer. The core has a center hardness of 70 Shore C or less, an outer surface hardness of 80 Shore C or less, and is formed from a polybutadiene blend composition comprising a first polybutadiene and a second polybutadiene. The center hardness of the core is at least 10 Shore C units less than the outer surface hardness of the core. The cover layer is formed from a thermoplastic composition.

In another embodiment, the present invention is directed to a three-layer golf ball having a compression of from 25 to 55 and consisting essentially of a dual core and a cover layer. The dual core has an overall compression of 30 or less and consists of a center formed from a first rubber composition and an outer core layer formed from a second rubber composition. In a particular aspect of this embodiment, the center has an SCDI compression of from 80 to 120 and a center hardness of from 53 Shore C to 65 Shore C, and the outer core layer has an outer surface hardness of from 55 Shore C to 70 Shore C. In another particular aspect of this embodiment, the center has an SCDI compression of from 20 to 79 and a center hardness of from 35 Shore C to 52 Shore C, and the outer core layer has an outer surface hardness of from 71 Shore C to 90 Shore C. The cover is formed from a thermoplastic composition.

DETAILED DESCRIPTION

Golf balls of the present invention are two-layer and three-layer balls including a core and a cover layer.

In one embodiment, the core is a solid, single-layer thermoset rubber core. In another embodiment, the core is a dual core, including a solid, single-layer thermoset rubber center and a single-layer thermoset rubber outer core layer disposed about the center.

The single-layer or dual core has an overall diameter of 1.600 inches or less, an overall compression of 40 or less, and an outer surface hardness of 90 Shore C or less.

The overall diameter of the core is preferably 1.500 inches or 1.530 inches or 1.550 inches or 1.570 inches or 1.580 inches or 1.585 inches or 1.590 inches or 1.595 inches or 1.600 inches or 1.620 inches or is within a range having a lower limit and an upper limit selected from these values.

In dual core embodiments of the present invention, the diameter of the center is preferably 0.500 or 0.600 or 0.750 or 0.800 or 1.000 or 1.015 or 1.020 or 1.025 or 1.050 or 1.100 or 1.200 or 1.300 or 1.350 or 1.400 or 1.500 or 1.510 or 1.530 or 1.550 inches, or is within a range having a lower limit and an upper limit selected from these values. The outer core layer preferably has a thickness of 0.010 or 0.020 or 0.025 or 0.030 or 0.032 or 0.050 or 0.070 or 0.075 or 0.080 or 0.100 or 0.150 or 0.175 or 0.200 or 0.250 or 0.280 or 0.300 or 0.310 or 0.400 or 0.440 or 0.500 or 0.560 inches, or has a thickness within a range having a lower limit and an upper limit selected from these values.

The overall compression of the core is preferably less than 45, or less than 40, or less than 35, or 30 or less, or less than 30, or less than 25, or less than 20, or 15 or less, or less than 15, or 10 or less, or less than 10, or 0 or less, or less than 0.

In dual core embodiments of the present invention, the center preferably has an SCDI compression of 120 or less, or an SCDI compression of from 80 to 120, or an SCDI compression of 79 or less, or an SCDI compression of from 20 to 79, or an SCDI compression of 20 or 30 or 40 or 50 or 60 or 70 or 80 or 90 or 100 or 120, or an SCDI compression within a range having a lower limit and an upper limit selected from these values. In a particular aspect of this embodiment, the compression of a 1.00-inch sphere of the center composition ($C_{center}$) is less than the compression of a 1.00-inch sphere of the outer core layer composition ($C_{outer}$), and the difference between $C_{center}$ and $C_{outer}$ is 10 units or greater, or 20 units or greater, or 30 units or greater, or 40 units or greater, or the difference is 10 or 20 or 30 or 40 or 50 or 60 or 70 units, or the difference is within a range having a lower limit and an upper limit selected from these values. In another particular aspect of this embodiment, $C_{center}$ is greater than $C_{outer}$, and the difference between $C_{center}$ and $C_{outer}$ is 10 units or greater, or 20 units or greater, or 30 units or greater, or 40 units or greater, or the difference is 10 or 20 or 30 or 40 or 50 or 60 or 70 units, or the difference is within a range having a lower limit and an upper limit selected from these values.

In one embodiment, the core preferably has an outer surface hardness of 80 Shore C or less. In another embodiment, the core preferably has an outer surface hardness of 90 Shore C or less.

In single-layer core embodiments of the present invention, the outer surface hardness of the core is preferably 80 Shore C or less, or 75 Shore C or less, or 70 Shore C or less, or is preferably 55 Shore C or 60 Shore C or 65 Shore C or 70 Shore C or 75 Shore C or 80 Shore C or 85 Shore C or is within a range having a lower limit and an upper limit selected from these values, and the center hardness of the core is preferably 80 Shore C or less, or 75 Shore C or less, or 70 Shore C or less, or 65 Shore C or less, or 60 Shore C or less, or 55 Shore C or less, or 50 Shore C or less, or is preferably 40 Shore C or 45 Shore C or 50 Shore C or 55 Shore C or 60 Shore C or 65 Shore C or 70 Shore C or 75 Shore C or 80 Shore C or 85 Shore C or is within a range having a lower limit and an upper limit selected from these values. The single-layer core may have an overall negative hardness gradient, zero hardness gradient, or positive hardness gradient of up to 45 Shore C units. Preferably, the core has a positive hardness gradient wherein the center hardness of the core is at least 10 Shore C units less than the outer surface hardness of the core, or the center hardness of the core is at least 15 Shore C units less than the outer surface hardness of the core, or the center hardness of the core is at least 20 Shore C units less than the outer surface hardness of the core, or the center hardness of the core is at least 25 Shore C units less than the outer surface hardness of the core; or the core has a positive hardness gradient wherein the difference between the center hardness of the core and the outer surface hardness of the core is 5 or 10 or 15 or 20 or 25 or 30 Shore C units or is within a range having a lower limit and an upper limit selected from these values.

In dual core embodiments of the present invention, the center preferably has a center hardness ($H_{center}$) of 65 Shore C or less, or a center hardness of 52 Shore C or less, or a center hardness of 35 or 50 or 52 or 53 or 55 or 60 or 65 Shore C, or a center hardness within a range having a lower limit and an upper limit selected from these values. The center preferably has an outer surface hardness of 90 Shore C or less, or 85 Shore C or less, or 80 Shore C or less, or 75 Shore C or less, or 70 Shore C or less, or an outer surface hardness of 55 Shore C or 60 Shore C or 65 Shore C or 70 Shore C or 75 Shore C or 80 Shore C or 85 Shore C or 90 Shore C, or an outer surface hardness within a range having a lower limit and an upper limit selected from these values.

The center may have a negative hardness gradient wherein the interface hardness of the center ($H_{center\ interface}$) is less than the center hardness, or a zero hardness gradient wherein the interface hardness of the center is within 1 hardness unit of the center hardness, or a positive hardness gradient wherein the interface hardness of the center is greater than the center hardness. The interface hardness of the center is defined herein as the hardness at a distance of 1 mm inward from the outer surface of the center. In a particular embodiment, the center has an overall zero hardness gradient; or a positive hardness gradient wherein $1<H_{center\ interface}-H_{center}<45$, or $1<H_{center\ interface}-H_{center}<15$, or $1<H_{center\ interface}-H_{center}<5$;

or a negative hardness gradient wherein $1<H_{center}-H_{center\ interface}<45$, or $1<H_{center}-H_{center\ interface}<15$, or $1<H_{center}-H_{center\ interface}<5$;

or a positive hardness gradient wherein $H_{center}$ is at least 10 Shore C units less than $H_{center\ interface}$.

The outer core layer preferably has an outer surface hardness ($H_{outer\ surface}$) of 90 Shore C or less, or 85 Shore C or less, or 80 Shore C or less, or 75 Shore C or less, or 70 Shore C or less, or an outer surface hardness of 55 Shore C or 60 Shore C or 65 Shore C or 70 Shore C or 75 Shore C or 80 Shore C or 85 Shore C or 90 Shore C, or an outer surface hardness within a range having a lower limit and an upper limit selected from these values.

The overall dual-layer core may have a negative hardness gradient wherein the outer surface hardness of the outer core layer is less than the center hardness, or a zero hardness gradient wherein the outer surface hardness of the outer core layer is within 1 hardness unit of the center hardness, or a positive hardness gradient wherein the outer surface hardness of the outer core layer is greater than the center hardness. In a particular embodiment, the dual-layer core has a positive, negative, or zero hardness gradient wherein the difference between the center Shore C hardness of the center and the outer surface Shore C hardness of the outer core layer is from 0 to 5. In another particular embodiment, the dual-layer core has a positive hardness gradient wherein $H_{center}$ is at least 15 Shore C units less than $H_{outer\ surface}$.

The coefficient of restitution, "COR," of the core is preferably 0.750 or greater, or 0.760 or greater, or 0.770 or greater or 0.780 or greater.

The core layer(s) are preferably formed from a rubber composition independently selected from rubber compositions comprising a base rubber selected from natural rubber, polybutadiene, polyisoprene, ethylene propylene rubber (EPR), ethylene-propylene-diene rubber (EPDM), styrene butadiene rubber, butyl rubber, halobutyl rubber, polyurethane, polyurea, acrylonitrile butadiene rubber, polychloroprene, alkyl acrylate rubber, chlorinated isoprene rubber, acrylonitrile chlorinated isoprene rubber, polyalkenamer, phenol formaldehyde, melamine formaldehyde, polyepoxide, polysiloxane, polyester, alkyd, polyisocyanurate, polycyanurate, polyacrylate, and combinations of two or more thereof. Diene rubbers are preferred, particularly polybutadiene, styrene butadiene, acrylonitrile butadiene, and mixtures of polybutadiene with other elastomers wherein the amount of polybutadiene present greater than 50 wt % based on the total polymeric weight of the mixture. In a particular embodiment, the core is a solid, single layer formed from a polybutadiene blend composition comprising a first polybutadiene and a second polybutadiene. In a particular aspect of this embodiment, the core composition further comprises styrene butadiene rubber. In another particular aspect of this embodiment, the first polybutadiene is present in the core composition in an amount of 50 phr or greater, or 60 phr or greater, or 65 phr or greater, or 70 phr or greater, or 75 phr or greater, or 80 phr or greater. In another particular aspect of this embodiment, the second polybutadiene is present in the core composition in an amount of 10 phr or greater, or 15 phr or greater, or 20 phr or greater. In another particular aspect of this embodiment, the styrene butadiene rubber is optionally present in the core composition in an amount of 3 phr or greater, or 5 phr or greater. In dual core embodiments of the present invention, the center and the outer core layer may be formed from the same or different rubber compositions.

Non-limiting examples of suitable commercially available rubbers are Buna CB high-cis neodymium-catalyzed polybutadiene rubbers, such as Buna CB 23, Buna CB24, and Buna CB high-cis cobalt-catalyzed polybutadiene rubbers, such as Buna CB 1203, 1220 and 1221, commercially available from Lanxess Corporation; SE BR-1220, commercially available from The Dow Chemical Company; Europrene® NEOCIS® BR 40 and BR 60, commercially available from Polimeri Europa®; UBEPOL-BR® rubbers, commercially available from UBE Industries, Inc.; BR 01, commercially available from Japan Synthetic Rubber Co., Ltd.; Neodene high-cis neodymium-catalyzed polybutadiene rubbers, such as Neodene BR 40, commercially available from Karbochem; TP-301 transpolyisoprene, commercially available from Kuraray Co., Ltd.; Vestenamer® polyoctenamer, commercially available from Evonik Industries; Butyl 065 and Butyl 288 butyl rubbers, commercially available from ExxonMobil Chemical Company; Butyl 301 and Butyl 101-3, commercially available from Lanxess Corporation; Bromobutyl 2224 and Chlorobutyl 1066 halobutyl rubbers, commercially available from ExxonMobil Chemical Company; Bromobutyl X2 and Chlorobutyl 1240 halobutyl rubbers, commercially available from Lanxess Corporation; BromoButyl 2255 butyl rubber, commercially available from Japan Synthetic Rubber Co., Ltd.; Vistalon® 404 and Vistalon® 706 ethylene propylene rubbers, commercially available from ExxonMobil Chemical Company; Dutral CO 058 ethylene propylene rubber, commercially available from Polimeri Europa; Nordel® IP NDR 5565 and Nordel® IP 3670 ethylene-propylene-diene rubbers, commercially available from The Dow Chemical Company; EPT1045 and EPT1045 ethylene-propylene-diene rubbers, commercially available from Mitsui Corporation; Buna SE 1721 TE styrene-butadiene rubbers, commercially available from Lanxess Corporation; Afpol 1500 and Afpol 552 styrene-butadiene rubbers, commercially available from Karbochem; Plioflex PLF 1502, commercially available from Goodyear Chemical; Nipol® DN407 and Nipol® 1041L acrylonitrile butadiene rubbers, commercially available from Zeon Chemicals, L.P.; Neoprene GRT and Neoprene AD30 polychloroprene rubbers; Vamac® ethylene acrylic elastomers, commercially available from E.I. du Pont de Nemours and Company; Hytemp® AR12 and AR214 alkyl acrylate rubbers, commercially available from Zeon Chemicals, L.P.; Hypalon® chlorosulfonated polyethylene rubbers, commercially available from E.I. du Pont de Nemours and Company; and Goodyear Budene® 1207 polybutadiene, commercially available from Goodyear Chemical. In a particular embodiment, the core is formed from a rubber composition comprising as the base rubber a blend of Neodene BR 40 polybutadiene, Budene® 1207 polybutadiene, and Buna SB 1502 styrene butadiene rubber. In another particular embodiment, the core is formed from a rubber composition comprising as the base rubber a blend of Neodene BR 40 polybutadiene, Buna CB 1221, and core regrind.

The rubber is crosslinked using, for example, a peroxide or sulfur cure system, C—C initiators, high energy radiation sources capable of generating free radicals, or a combination thereof.

In a particular embodiment, the rubber is crosslinked using a peroxide initiator and optionally a coagent. Suitable peroxide initiators include, but are not limited to, organic peroxides, such as dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butyl-peroxyisopropyl)benzene; dilauroyl peroxide; dibenzoyl peroxide; t-butyl hydroperoxide; lauryl peroxide; benzoyl peroxide; and combinations thereof. Examples of suitable commercially available peroxides include, but are not limited to Perkadox® BC dicumyl peroxide, commercially available from Akzo Nobel, and Varox® peroxides, such as Varox® ANS benzoyl peroxide and Varox® 231 1,1-di(t-butylperoxy)3,3,5-trimethylcyclohexane, commercially available from RT Vanderbilt Company, Inc.

The amount of peroxide initiator used to form the rubber composition is generally at least 0.05 parts by weight per 100 parts of the base rubber, or is 0.05 parts or 0.1 parts or 0.25 parts or 0.6 parts or 0.8 parts or 1 part or 1.25 parts or 1.5 parts or 2.0 parts or 2.5 parts or 3 parts or 5 parts or 6 parts or 10 parts or 15 parts by weight per 100 parts of the base rubber, or is within a range having a lower limit and an upper limit selected from these values.

Coagents are commonly used with peroxides to increase the state of cure. Suitable coagents include, but are not limited to, metal salts of unsaturated carboxylic acids; unsaturated vinyl compounds and polyfunctional monomers (e.g., trimethylolpropane trimethacrylate); maleimides (e.g., phenylene bismaleimide); and combinations thereof. Particular examples of suitable metal salts of unsaturated carboxylic acids include, but are not limited to, one or more metal salts of acrylates, diacrylates, methacrylates, and dimethacrylates, wherein the metal is selected from magnesium, calcium, zinc, aluminum, lithium, nickel, and sodium. In a particular embodiment, the coagent is selected from zinc salts of acrylates, diacrylates, methacrylates, dimethacrylates, and mixtures thereof. In another particular embodiment, the coagent is zinc diacrylate.

When the coagent is zinc diacrylate and/or zinc dimethacrylate, the amount of coagent used to form the rubber composition is generally 1 or 5 or 10 or 15 or 19 or 20 or 24 or 25 or 30 or 35 or 40 or 45 or 50 or 60 parts by weight per 100 parts of the base rubber, or is within a range having a lower limit and an upper limit selected from these values. When one or more less active coagents are used, such as zinc monomethacrylate and various liquid acrylates and methacrylates, the amount of less active coagent used may be the same as or higher than for zinc diacrylate and zinc dimethacrylate coagents.

In another particular embodiment, the rubber is crosslinked using sulfur and/or an accelerator. Suitable accelerators include, but are not limited to, guanidines (e.g., diphenyl guanidine, triphenyl guanidine, and di-ortho-tolyl guanidine); thiazoles (e.g., mercaptobenzothiazole, dibenzothiazyldisulfide, sodium salt of mercaptobenzothiazole, zinc salt of mercaptobenzothiazole, and 2,4-dinitrophenyl mercaptobenzothiazole); sulfenamides (e.g., N-cyclohexylbenzothiazylsulfenamide, N-oxydiethylbenzothiazylsulfenamide, N-t-butylbenzothiazylsulfenamide, and N,N'-dicyclohexylbenzothiazylsulfenamide); thiuram sulfides (e.g., tetramethyl thiuram disulfide, tetraethyl thiuram disulfide, tetrabutylthiuram disulfide, tetramethyl thiuram monosulfide, dipentamethylene thiuram tetrasulfate, 4-morpholinyl-2-benzothiazole disulfide, and dipentamethylenethiuram hexasulfide); dithiocarbamates (e.g., piperidine pentamethylene dithiocarbamate, zinc diethyl dithiocarbamate, sodium diethyl dithiocarbamate, zinc ethyl phenyl dithiocarbamate, and bismuth dimethyldithiocarbamate); thioureas (e.g., ethylene thiourea, N,N'-diethylthiourea, and N,N'-diphenylthiourea); xanthates (e.g., zinc isopropyl xanthate, sodium isopropyl xanthate, and zinc butyl xanthate); dithiophosphates; and aldehyde amines (e.g., hexamethylene tetramine and ethylidene aniline).

The crosslinking system optionally includes one or more activators selected from metal oxides (e.g., zinc oxide and magnesium oxide), and fatty acids and salts of fatty acids (e.g., stearic acid, zinc stearate, oleic acid, and dibutyl ammonium oleate).

The rubber composition optionally includes a scorch retarder to prevent scorching of the rubber during processing before vulcanization. Suitable scorch retarders include, but are not limited to, salicylic acid, benzoic acid, acetylsalicylic acid, phthalic anhydride, sodium acetate, and N-cyclohexylthiophthalimide.

The rubber composition optionally includes one or more antioxidants to inhibit or prevent the oxidative degradation of the base rubber. Some antioxidants also act as free radical scavengers; thus, when antioxidants are included in the composition, the amount of initiator agent used may be as high as or higher than the amounts disclosed herein. Suitable antioxidants include, but are not limited to, hydroquinoline antioxidants, phenolic antioxidants, and amine antioxidants.

The rubber composition optionally includes a soft and fast agent selected from organosulfur and metal-containing organosulfur compounds; organic sulfur compounds, including mono, di, and polysulfides, thiol, and mercapto compounds; inorganic sulfide compounds; blends of an organosulfur compound and an inorganic sulfide compound; Group VIA compounds; substituted and unsubstituted aromatic organic compounds that do not contain sulfur or metal; aromatic organometallic compounds; hydroquinones; benzoquinones; quinhydrones; catechols; resorcinols; and combinations thereof. In a particular embodiment, the soft and fast agent is selected from zinc pentachlorothiophenol, pentachlorothiophenol, ditolyl disulfide, diphenyl disulfide, dixylyl disulfide, 2-nitroresorcinol, and combinations thereof.

The rubber composition optionally contains one or more fillers. Exemplary fillers include precipitated hydrated silica, clay, talc, asbestos, glass fibers, aramid fibers, mica, calcium metasilicate, zinc sulfate, barium sulfate, zinc sulfide, lithopone, silicates, silicon carbide, diatomaceous earth, carbonates (e.g., calcium carbonate, zinc carbonate, barium carbonate, and magnesium carbonate), metals (e.g., titanium, tungsten, aluminum, bismuth, nickel, molybdenum, iron, lead, copper, boron, cobalt, beryllium, zinc, and tin), metal alloys (e.g., steel, brass, bronze, boron carbide whiskers, and tungsten carbide whiskers), oxides (e.g., zinc oxide, tin oxide, iron oxide, calcium oxide, aluminum oxide, titanium dioxide, magnesium oxide, and zirconium oxide), particulate carbonaceous materials (e.g., graphite, carbon black, cotton flock, natural bitumen, cellulose flock, and leather fiber), microballoons (e.g., glass and ceramic), fly ash, core material that is ground and recycled, nanofillers and combinations thereof.

The rubber composition may also contain one or more additives selected from processing aids, such as transpolyisoprene (e.g., TP-301 transpolyisoprene, commercially available from Kuraray Co., Ltd.), transbutadiene rubber, and polyalkenamer rubber; processing oils; plasticizers; coloring agents; fluorescent agents; chemical blowing and foaming agents; defoaming agents; stabilizers; softening agents; impact modifiers; free radical scavengers; antiozonants (e.g., p-phenylenediames); and the like.

Suitable types and amounts of rubber, initiator agent, coagent, filler, and additives are more fully described in, for example, U.S. Pat. Nos. 6,566,483, 6,695,718, 6,939,907, 7,041,721 and 7,138,460, the entire disclosures of which are hereby incorporated herein by reference. Particularly suitable diene rubber compositions are further disclosed, for example, in U.S. Patent Application Publication No. 2007/0093318, the entire disclosure of which is hereby incorporated herein by reference.

The cover is preferably a single layer having a thickness of 0.010 inches or greater and an outer surface hardness of 50 Shore D or greater. The thickness of the cover is preferably 0.020 inches or 0.030 inches or 0.035 inches or 0.040 inches or 0.045 inches or 0.050 inches or 0.055 inches or 0.060 inches or 0.065 inches or is within a range having a lower limit and an upper limit selected from these values. The outer surface hardness of the cover is preferably 50 Shore D or greater, or 55 Shore D or greater, or greater than 55 Shore D, or 58 Shore D or greater, or greater than 58 Shore D, or 60 Shore D or greater, or greater than 60 Shore D, or is 55 Shore D or 58 Shore D or 60 Shore D or 61 Shore D or 63 Shore D or 64 Shore D or 65 Shore D or 68 Shore D or 70 Shore D or is within a range having a lower limit and an upper limit selected from these values.

Suitable cover materials include, but are not limited to, ionomer resins and blends thereof (e.g., Surlyn® ionomer resins and DuPont® HPF 1000 and HPF 2000, commercially available from E.I. du Pont de Nemours and Company; Iotek® ionomers, commercially available from ExxonMobil Chemical Company; Amplify® IO ionomers of ethylene acrylic acid copolymers, commercially available from The Dow Chemical Company; and Clarix® ionomer resins, commercially available from A. Schulman Inc.); polyurethanes, polyureas, and hybrids of polyurethane and polyurea; polyisoprene; polyoctenamer, such as Vestenamer® polyoctenamer, commercially available from Evonik Industries; polyethylene, including, for example, low density polyethylene, linear low density polyethylene, and high density polyethylene; polypropylene; rubber-toughened olefin polymers; non-ionomeric acid copolymers, e.g., (meth)acrylic acid, which do not become part of an ionomeric copolymer; plastomers; flexomers; styrene/butadiene/styrene block copolymers; styrene/ethylene-butylene/styrene block copolymers; polybutadiene; styrene butadiene rubber; ethylene propylene rubber; ethylene propylene diene rubber; dynamically vulcanized elastomers; ethylene vinyl acetates; ethylene (meth)acrylates; polyvinyl chloride resins; polyamides, amide-ester elastomers, and copolymers of ionomer and polyamide, including, for example, Pebax® thermoplastic polyether and polyester amides, commercially available from Arkema Inc; crosslinked trans-polyisoprene; polyester-based thermoplastic elastomers, such as Hytrel® polyester elastomers, commercially available from E.I. du Pont de Nemours and Company, and Riteflex® polyester elastomers, commercially available from Ticona; polyurethane-based thermoplastic elastomers, such as Elastollan® polyurethanes, commercially available from BASF; synthetic or natural vulcanized rubber; and combinations thereof.

Ionomer compositions are particularly suitable for forming cover layers in golf balls of the present invention. Suitable ionomers include partially neutralized ionomers, blends of two or more partially neutralized ionomers, highly neutralized ionomers, blends of two or more highly neutralized ionomers, and blends of one or more partially neutralized ionomers with one or more highly neutralized ionomers. Preferred ionomers are salts of O/X- and O/X/Y-type acid copolymers, wherein O is an $\alpha$-olefin, X is a $C_3$-$C_8$ $\alpha,\beta$-ethylenically unsaturated carboxylic acid, and Y is a softening monomer. O is preferably selected from ethylene and propylene. X is preferably selected from methacrylic acid, acrylic acid, ethacrylic acid, maleic acid, crotonic acid, fumaric acid, and itaconic acid. Methacrylic acid and acrylic acid are particularly preferred. As used herein, "(meth) acrylic acid" means methacrylic acid and/or acrylic acid. Likewise, "(meth)acrylate" means methacrylate and/or acrylate. Y is preferably selected from (meth)acrylate and alkyl (meth)acrylates wherein the alkyl groups have from 1 to 8 carbon atoms, including, but not limited to, n-butyl (meth) acrylate, isobutyl (meth)acrylate, methyl (meth)acrylate, and ethyl (meth)acrylate. Particularly preferred O/X/Y-type copolymers are ethylene/(meth)acrylic acid/n-butyl acrylate, ethylene/(meth)acrylic acid/methyl acrylate, and ethylene/(meth)acrylic acid/ethyl acrylate. The acid is typically present in the acid copolymer in an amount of 1 or 4 or 6 or 8 or 10 or 11 or 12 or 15 or 16 or 20 or 25 or 30 or 35 or 40 wt %, based on the total weight of the acid copolymer, or an amount within a range having a lower limit and an upper limit selected from these values. The acid copolymer is at least partially neutralized with a cation source, optionally in the presence of a high molecular weight organic acid, such as those disclosed in U.S. Pat. No. 6,756,436, the entire disclosure of which is hereby incorporated herein by reference. Suitable cation sources include, but are not limited to, metal ions and compounds of alkali metals, alkaline earth metals, and transition metals; metal ions and compounds of rare earth elements; ammonium salts and monoamine salts; and combinations thereof. Preferred cation sources are metal ions and compounds of magnesium, sodium, potassium, cesium, calcium, barium, manganese, copper, zinc, tin, lithium, and rare earth metals.

Particularly preferred ionomeric cover compositions include:

(a) a composition comprising a "high acid ionomer" (i.e., having an acid content of greater than 16 wt %), such as Surlyn 8150®;

(b) a composition comprising a high acid ionomer and a maleic anhydride-grafted non-ionomeric polymer (e.g., Fusabond® functionalized polymers). A particularly preferred blend of high acid ionomer and maleic anhydride-grafted polymer is a 84 wt %/16 wt % blend of Surlyn 8150® and Fusabond®. Blends of high acid ionomers with maleic anhydride-grafted polymers are further disclosed, for example, in U.S. Pat. Nos. 6,992,135 and 6,677,401, the entire disclosures of which are hereby incorporated herein by reference;

(c) a composition comprising a 50/45/5 blend of Surlyn® 8940/Surlyn® 9650/Nucrel® 960, preferably having a material hardness of from 80 to 85 Shore C;

(d) a composition comprising a 50/25/25 blend of Surlyn® 8940/Surlyn® 9650/Surlyn® 9910, preferably having a material hardness of about 90 Shore C;

(e) a composition comprising a 50/50 blend of Surlyn® 8940/Surlyn® 9650, preferably having a material hardness of about 86 Shore C;

(f) a composition comprising a blend of Surlyn® 7940/Surlyn® 8940, optionally including a melt flow modifier;

(g) a composition comprising a blend of a first high acid ionomer and a second high acid ionomer, wherein the first high acid ionomer is neutralized with a different cation than the second high acid ionomer (e.g., 50/50 blend of Surlyn® 8150 and Surlyn® 9150), optionally including one or more melt flow modifiers such as an ionomer, ethylene-acid copolymer or ester terpolymer;

(h) a composition comprising a blend of a first high acid ionomer and a second high acid ionomer, wherein the first high acid ionomer is neutralized with a different cation than the second high acid ionomer, and from 0 to 10 wt % of an ethylene/acid/ester ionomer wherein the ethylene/acid/ester ionomer is neutralized with the same cation as either the first high acid ionomer or the second high acid ionomer or a different cation than the first and second high acid ionomers (e.g., a blend of 40-50 wt % Surlyn® 8140, 40-50 wt % Surlyn® 9120, and 0-10 wt % Surlyn® 6320);

(i) a composition comprising a 60/25/15 blend of Surlyn® 9945/Surlyn® 8940/Surlyn® 8320;

(j) a composition comprising a 60/40 blend of Surlyn® 9945/Surlyn® 8320;

(k) a composition comprising an 80/20 blend of Surlyn® 9945/Surlyn® 8320;

(l) a composition comprising a 60/25/15 blend of Surlyn® 9945/Surlyn® 8940/Surlyn® AD1022;

(m) a composition comprising a 60/25/15 blend of Surlyn® 9945/Surlyn® 8940/Surlyn® AD 1043;

(n) a composition comprising a 60/40 blend of Surlyn® 9945/Surlyn® AD1022;

(o) a composition comprising a 60/40 blend of Surlyn® 9945/Surlyn® AD1043;

(p) a composition comprising a single ionomer, wherein the ionomer is Surlyn® AD1043; and (q) a composition comprising a 57/20/23 blend of Surlyn® 7940/Surlyn® 8945/Fusabond® N525.

Surlyn 8150®, Surlyn® 8940, Surlyn® 8140, and Suryln® 8320 are different grades of E/MAA copolymer in which the acid groups have been partially neutralized with sodium ions. Surlyn® 9650, Surlyn® 9910, Surlyn® 9150, Surlyn® 9120 and Surlyn® 9945 are different grades of E/MAA copolymer in which the acid groups have been partially neutralized with zinc ions. Surlyn® 7940 is an E/MAA copolymer in which the acid groups have been partially neutralized with lithium ions. Surlyn® 6320 is a very low modulus magnesium ionomer with a medium acid content. Nucrel® 960 is an E/MAA copolymer resin nominally made with 15 wt % methacrylic acid. Fusabond® 525D is a metallocene-catalyzed polyethylene. Surlyn® ionomers, Fusabond® polymers, and Nucrel® copolymers are commercially available from E.I. du Pont de Nemours and Company.

Suitable ionomers also include polypropylene ionomers, including grafted polypropylene ionomers. Examples of commercially available polypropylene ionomers include, but are not limited to, Clarix® 130640 and 230620 acrylic acid-grafted polypropylene ionomers, commercially available from A. Schulman Inc., and Priex® 40101, 42101, 45101, and 48101, maleic anhydride-grafted polypropylene ionomers, commercially available from Solvay Engineered Polymers, Inc.

Suitable ionomers also include polyester ionomers, including, but not limited to, those disclosed, for example, in U.S. Pat. Nos. 6,476,157 and 7,074,465, the entire disclosures of which are hereby incorporated herein by reference.

Suitable ionomers also include low molecular weight ionomers, such as AClyn® 201, 201A, 295, 295A, 246, 246A, 285, and 285A low molecular weight ionomers, commercially available from Honeywell International Inc.

Suitable ionomers also include ionomer compositions comprising an ionomer and potassium ions, such as those disclosed, for example, in U.S. Pat. No. 7,825,191, the entire disclosure of which is hereby incorporated herein by reference.

Ionomeric cover compositions can be blended with non-ionic thermoplastic resins, particularly to manipulate product properties. Examples of suitable non-ionic thermoplastic resins include, but are not limited to, polyurethane, polyether-ester, poly-amide-ether, polyether-urea, thermoplastic polyether block amides (e.g., Pebax® block copolymers, commercially available from Arkema Inc.), styrene-butadiene-styrene block copolymers, styrene(ethylene-butylene)-styrene block copolymers, polyamides, polyesters, polyolefins (e.g., polyethylene, polypropylene, ethylene-propylene copolymers, polyethylene-(meth)acrylate, polyethylene-(meth)acrylic acid, functionalized polymers with maleic anhydride grafting, Fusabond® functionalized polymers commercially available from E.I. du Pont de Nemours and Company, functionalized polymers with epoxidation, elastomers (e.g., ethylene propylene diene monomer rubber, metallocene-catalyzed polyolefin) and ground powders of thermoset elastomers.

Ionomer golf ball cover compositions may include a flow modifier, such as, but not limited to, acid copolymer resins (e.g., Nucrel® acid copolymer resins, and particularly Nucrel® 960, commercially available from E.I. du Pont de Nemours and Company), performance additives (e.g., A-C® performance additives, particularly A-C® low molecular weight ionomers and copolymers, A-C® oxidized polyethylenes, and A-C® ethylene vinyl acetate waxes, commercially available from Honeywell International Inc.), fatty acid amides (e.g., ethylene bis-stearamide and ethylene bis-oleamide), fatty acids and salts thereof Suitable ionomeric cover materials are further disclosed, for example, in U.S. Patent Application Publication Nos. 2005/0049367, 2005/0148725, 2005/0020741, 2004/0220343, and 2003/0130434, and U.S. Pat. Nos. 5,587,430, 5,691,418, 5,866,658, 6,100,321, 6,562,906, 6,653,382, 6,756,436, 6,777,472, 6,762,246, 6,815,480, 6,894,098, 6,919,393, and 6,953,820, the entire disclosures of which are hereby incorporated herein by reference.

Cover compositions may include one or more filler(s), such as the fillers given above for rubber compositions of the present invention (e.g., titanium dioxide, barium sulfate, etc.), and/or additive(s), such as coloring agents, fluorescent agents, whitening agents, antioxidants, dispersants, UV absorbers, light stabilizers, plasticizers, surfactants, compatibility agents, foaming agents, reinforcing agents, release agents, and the like.

In a particular embodiment, the cover is a single layer having a thickness of from 0.035 inches to 0.060 inches, an outer surface hardness of 60 Shore D or greater, and formed from a thermoplastic composition comprising a blend of two or more ionomers.

Golf balls of the present invention typically have a coefficient of restitution, "COR," of 0.780 or greater, or 0.790 or greater.

Golf balls of the present invention typically have a compression of 60 or less, or 55 or less, or 50 or less, or less than 50, or 45 or less, or less than 45, or 40 or less, or less than 40, or a compression of 20 or 25 or 30 or 35 or 40 or 45 or 50 or 55 or 60 or within a range having a lower limit and an upper limit selected from these values.

Golf balls of the present invention typically have an overall diameter of 1.680 inches or 1.690 inches or 1.700 inches or 1.720 inches or 1.740 inches or 1.780 inches or 1.800 inches or an overall diameter within a range having a lower limit and an upper limit selected from these values.

Golf balls of the present invention typically have dimple coverage of 60% or greater, or 65% or greater, or 75% or greater, or 80% or greater, or 85% or greater.

In a particular embodiment, the dimple pattern includes 376 dimples arranged in a tetrahedron pattern. In a particular aspect of this embodiment, a majority of the dimples have a 14° edge angle. In another particular aspect of this embodiment, the dimples have an aerodynamic coefficient magnitude of from 0.25 to 0.28 and an aerodynamic force angle of from 34° to 46° at a Reynolds Number of 230000 and a spin ratio of 0.080. In another particular aspect of this embodiment, the dimples have an aerodynamic coefficient magnitude of from 0.26 to 0.29 and an aerodynamic force angle of from 36° to 48° at a Reynolds Number of 208000 and a spin ratio of 0.090. In another particular aspect of this embodiment, the dimples have an aerodynamic coefficient magnitude of from 0.26 to 0.30 and an aerodynamic force angle of from 38° to 50° at a Reynolds Number of 190000 and a spin ratio of 0.100. In another particular aspect of this embodiment, the dimples have an aerodynamic coefficient magnitude of from 0.27 to 0.32 and an aerodynamic force angle of from 40° to 55° at a Reynolds Number of 170000 and a spin ratio of 0.110. For purposes of the present disclosure, aerodynamic coefficient magnitude ($C_{mag}$) is defined by $C_{mag}=(C_L^2+C_D^2)^{1/2}$ and aerodynamic force angle ($C_{angle}$) is defined by $C_{angle}=\tan^{-1}(C_L/C_D)$, where $C_L$ is a lift coefficient and $C_D^2$ is a drag coefficient. Aerodynamic characteristics of a golf ball, including aerodynamic coefficient magnitude and aerodynamic force angle, are disclosed, for example, in U.S. Pat. No. 6,913,550 to Bissonnette et al., the entire disclosure of which is hereby incorporated herein by reference.

The present invention is not limited by any particular process for forming the golf ball layer(s). It should be understood that the layer(s) can be formed by any suitable technique, including injection molding, compression molding, casting, and reaction injection molding. In particular, the relatively thin outer core layer may be formed by any conventional means for forming a thin thermosetting layer comprising a vulcanized or otherwise crosslinked diene rubber including, but not limited to, compression molding, rubber-injection molding, casting of a liquid rubber, and laminating.

The surface hardness of a golf ball layer is obtained from the average of a number of measurements taken from opposing hemispheres, taking care to avoid making measurements on the parting line of the core or on surface defects, such as holes or protrusions. Hardness measurements are made on the outer surface of the layer pursuant to ASTM D-2240 "Indentation Hardness of Rubber and Plastic by Means of a Durometer." Because of the curved surface, care must be taken to insure that the golf ball or golf ball subassembly is centered under the durometer indentor before a surface hardness reading is obtained. A calibrated, digital durometer, capable of reading to 0.1 hardness units is used for all hardness measurements and is set to take hardness readings at 1 second after the maximum reading is obtained. The digital durometer must be attached to, and its foot made parallel to, the base of an automatic stand. The weight on the durometer and attack rate conform to ASTM D-2240.

The center hardness of a core is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within ±0.004 inches. Leaving the core in the holder, the center of the core is found with a center square and carefully marked and the hardness is measured at the center mark according to ASTM D-2240. Additional hardness measurements at any distance from the center of the core can then be made by drawing a line radially outward from the center mark, and measuring the hardness at any given distance along the line, typically in 2 mm increments from the center. The hardness measurement at a distance of 1 mm inward from the outer surface of the center is defined herein as the interface hardness of the center ($H_{center\ interface}$). The hardness at a particular distance from the center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

Hardness points should only be measured once at any particular geometric location.

For purposes of the present disclosure, a hardness gradient of a core is defined by hardness measurements made at the outer surface of the core and the center point of the core. "Negative" and "positive" refer to the result of subtracting the hardness value at the innermost portion of the core from the hardness value at the outer surface of the core. For example, if the outer surface of a core has a lower hardness value than the center (i.e., the surface is softer than the center), the hardness gradient will be deemed a "negative" gradient. In measuring the hardness gradient of a core, the center hardness is first determined according to the procedure above for obtaining the center hardness of a core. Once the center of the core is marked and the hardness thereof is determined, hardness measurements at any distance from the center of the core may be measured by drawing a line radially outward from the center mark, and measuring and marking the distance from the center, typically in 2 mm increments. All hardness measurements performed on a plane passing through the geometric center are performed while the core is still in the holder and without having disturbed its orientation, such that the test surface is constantly parallel to the bottom of the holder. The hardness difference from any predetermined location on the core is calculated as the average surface hardness minus the hardness at the appropriate reference point, e.g., at the center of the core for a single, solid core, such that a core surface softer than its center will have a negative hardness gradient.

It should be understood that there is a fundamental difference between "material hardness" and "hardness as measured directly on a golf ball." For purposes of the present disclosure, material hardness is measured according to ASTM D2240 and generally involves measuring the hardness of a flat "slab" or "button" formed of the material. Hardness as measured directly on a golf ball (or other spherical surface) typically results in a different hardness value. This difference in hardness values is due to several factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other.

Thermoplastic layers herein may be treated in such a manner as to create a positive or negative hardness gradient. In golf ball layers of the present invention wherein a thermosetting rubber is used, gradient-producing processes and/or gradient-producing rubber formulation may be employed. Gradient-producing processes and formulations are disclosed more fully, for example, in U.S. patent application Ser. No. 12/048,665, filed on Mar. 14, 2008; Ser. No. 11/829,461, filed on Jul. 27, 2007; Ser. No. 11/772,903, filed Jul. 3, 2007; Ser. No. 11/832,163, filed Aug. 1, 2007; Ser. No. 11/832,197, filed on Aug. 1, 2007; the entire disclosure of each of these references is hereby incorporated herein by reference.

Hardness gradients are disclosed more fully, for example, in U.S. Pat. No. 7,429,221, and U.S. patent application Ser. No. 11/939,632, filed on Nov. 14, 2007; Ser. No. 11/939,634, filed on Nov. 14, 2007; Ser. No. 11/939,635, filed on Nov. 14, 2007; and Ser. No. 11/939,637, filed on Nov. 14, 2007; the entire disclosure of each of these references is hereby incorporated herein by reference.

As disclosed in Jeff Dalton's *Compression by Any Other Name, Science and Golf IV, Proceedings of the World Scientific Congress of Golf* (Eric Thain ed., Routledge, 2002) ("J. Dalton"), several different methods can be used to measure compression, including Atti compression, Riehle compression, load/deflection measurements at a variety of fixed loads and offsets, and effective modulus. For purposes of the present invention, unless otherwise indicated, "compression" refers to Atti compression and is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Very low stiffness cores will not cause the spring to deflect by more than 1.25 mm and therefore have a zero compression measurement. The Atti compression tester is designed to measure objects having a diameter of 1.680 inches; thus, smaller objects, such as golf ball cores, must be shimmed to a total height of 1.680 inches to obtain an accurate reading. Conversion from Atti compression to Riehle (cores), Riehle (balls), 100 kg deflection, 130-10 kg deflection or effective modulus can be carried out according to the formulas given in J. Dalton.

For purposes of the present invention, when compression values are indicated as SCDI, SCDI refers to Soft Center Deflection Index, and measured as follows. SCDI is a program change for the Dynamic Compression Machine ("DCM") that allows determination of the pounds required to deflect a core 10% of its diameter. The DCM is an apparatus that applies a load to a core or ball and measures the number of inches the core or ball is deflected at measured loads. A crude load/deflection curve is generated that is fit to the Atti compression scale that results in a number being generated that represents an Atti compression. The DCM does this via a load cell attached to the bottom of a hydraulic cylinder that is triggered pneumatically at a fixed rate (typically about 1.0 ft/s) towards a stationary core. Attached to the cylinder is an LVDT that measures the distance the cylinder travels during the testing timeframe. A software-based logarithmic algorithm ensures that measurements are not taken until at least five successive increases in load are detected during the initial phase of the test. The SCDI is a slight variation of this set up. The hardware is the same, but the software and output has changed. With the SCDI, the interest is in the pounds of force required to deflect a core x amount of inches. That amount of deflection is 10% percent of the core diameter. The DCM is triggered, the cylinder deflects the core by 10% of its diameter, and the DCM reports back the pounds of force required (as measured from the attached load cell) to deflect the core by that amount. The value displayed is a single number in units of pounds.

COR, as used herein, is determined according to a known procedure wherein a golf ball or golf ball subassembly (e.g., a golf ball core) is fired from an air cannon at two given velocities and calculated at a velocity of 125 ft/s. Ballistic light screens are located between the air cannon and the steel plate at a fixed distance to measure ball velocity. As the ball travels toward the steel plate, it activates each light screen, and the time at each light screen is measured. This provides an incoming transit time period inversely proportional to the ball's incoming velocity. The ball impacts the steel plate and rebounds though the light screens, which again measure the time period required to transit between the light screens. This provides an outgoing transit time period inversely proportional to the ball's outgoing velocity. COR is then calculated as the ratio of the outgoing transit time period to the incoming transit time period, $COR=V_{out}/V_{in}=T_{in}/T_{out}$.

EXAMPLES

It should be understood that the examples below are for illustrative purposes only. In no manner is the present invention limited to the specific disclosures therein.

Two-Layer Golf Balls

Solid, single-layer cores were made by curing spheres of a polybutadiene blend composition at 305-350° F. for 5-15 minutes. The relative amount of each component used to form the core composition is given in Table 1 below. Amounts are reported in phr, unless otherwise indicated.

Diameter, weight, compression, COR, center hardness, and surface hardness of each core was measured and the results are reported in Table 1 below.

TABLE 1

| | Example 1 | Example 2 |
|---|---|---|
| Core Composition | | |
| Neodene BR 40 | 70 | 85 |
| Budene 1207G | 22 | — |
| Buna SB 1502 | 8 | — |
| Buna CB 1221 | — | 15 |
| Dymalink 526 | 16.15 | 19.5 |
| Zinc Oxide | 5 | 5 |
| Perkadox BC-FF | 1 | 0.6 |
| Rhenogran Zn-PCTP-70 | 0.75 | 0.7 |
| Aflux 16 | — | 1 |
| Polywate 325 | — | 21.3 |
| Limestone | 24.8 | — |
| Core Regrind | 26.5 | 15 |
| Color Masterbatch | 0.17 | — |
| Core diameter (inches) | 1.577 | 1.582 |
| Core Properties | | |
| Weight (oz) | 1.366 | 1.373 |
| Compression | 19 | 13 |
| COR | 0.779 | 0.783 |
| Surface Hardness (Shore C) | 71.9 | 69.6 |
| Center Hardness (Shore C) | 50.8 | 51.8 |

A single layer cover of an ionomer blend composition was molded over each core to form a golf ball having an overall diameter of about 1.680 inches and a dimple pattern including 376 dimples arranged in a tetrahedron pattern. In Example 3 below, a 60/25/15 blend of Surlyn® 9945/Surlyn® 8940/Suryln® 8320 was molded over the core of Example 1 above. In Example 4 below, a 60/40 blend of Surlyn® 9945/Suryln® 8320 was molded over the core of Example 2 above. Compression, COR, and surface hardness of each ball was measured and the results are reported in Table 2 below.

TABLE 2

| | Example 3 | Example 4 |
|---|---|---|
| Ball Properties | | |
| Compression | 44 | 34 |
| COR | 0.797 | 0.790 |
| Surface Hardness (Shore D) | 64.8 | 61.3 |

Three-Layer Golf Balls

Solid centers were made by curing 1.02-inch spheres of a polybutadiene composition at 305-350° F. for 5-15 minutes. The relative amount of each component used to form the center composition is given in Table 3 below. Amounts are reported in phr, unless otherwise indicated.

Compression and center hardness of the centers were measured and the results are reported in Table 3 below.

Outer core layers of various compositions were formed thereon to produce a dual core having an outer diameter of about 1.58 inches. The relative amounts of each component used to form the outer core layer compositions are given in Table 3 below, and are reported in phr, unless otherwise indicated.

Compression, COR, and outer surface hardness of the dual cores were measured and the results are reported in Table 3 below. Hardness at various distances from the center of each dual core was also measured and the results are reported in Table 3 below.

A single layer cover of an ionomer blend composition was molded over each dual core to form a golf ball having an overall diameter of about 1.680 inches and a dimple pattern including 376 dimples arranged in a tetrahedron pattern. In Examples 5 and 7 below, a 60/40 blend of Surlyn® 9945/Suryln® 8320 was molded over the dual core. In Examples 6 and 8 below, an 80/20 blend of Surlyn® 9945/Suryln® 8320 was molded over the dual core. Compression, COR, and surface hardness of each ball was measured and the results are reported in Table 3 below.

TABLE 3

| | Example 5 | Example 6 | Example 7 | Example 8 |
|---|---|---|---|---|
| Center Composition | | | | |
| Polybutadiene | 100 | 100 | 100 | 100 |
| Regrind | 15 | 15 | 15 | 15 |
| Zinc oxide | 5 | 5 | 5 | 5 |
| Zinc diacrylate | 15 | 15 | 25 | 25 |

TABLE 3-continued

| | Example 5 | Example 6 | Example 7 | Example 8 |
|---|---|---|---|---|
| Dicumyl peroxide | 0.8 | 0.8 | 0.8 | 0.8 |
| Zinc pentachlorothiophenol dispersion | 0.7 | 0.7 | 0.7 | 0.7 |
| Barium Sulfate | 16.5 | 16.5 | 16.5 | 16.5 |
| Center Properties | | | | |
| Center Compression (SCDI) | 47 | 47 | 105 | 105 |
| Center Hardness (Shore C) | 46 | 46 | 58 | 58 |
| Outer Core Layer Composition | | | | |
| Polybutadiene | 100 | 100 | 100 | 100 |
| Regrind | 15 | 15 | 15 | 15 |
| Zinc oxide | 5 | 5 | 5 | 5 |
| Zinc diacrylate | 25 | 25 | 15 | 15 |
| Dicumyl peroxide | 0.8 | 0.8 | 0.8 | 0.8 |
| Zinc pentachlorothiophenol dispersion | 0.7 | 0.7 | 0.7 | 0.7 |
| Barium Sulfate | 16.5 | 16.5 | 16.5 | 16.5 |
| Dual Core Properties | | | | |
| Overall Dual Core Compression (Atti) | 25 | 25 | 20 | 20 |
| Overall Dual Core COR | 0.792 | 0.792 | 0.785 | 0.785 |
| Outer Surface Hardness (Shore C) | 80 | 80 | 62 | 62 |
| Hardness at various distances from center (Shore C) | | | | |
| 2 mm from center | 49 | 49 | 60 | 60 |
| 4 mm from center | 51 | 51 | 63 | 63 |
| 6 mm from center | 53 | 53 | 64 | 64 |
| 8 mm from center | 55 | 55 | 67 | 67 |
| 10 mm from center | 57 | 57 | 72 | 72 |
| 12 mm from center | 59 | 59 | 72 | 72 |
| 14 mm from center | 66 | 66 | 57 | 57 |
| 16 mm from center | 70 | 70 | 58 | 58 |
| 18 mm from center | 73 | 73 | 59 | 59 |
| calculated interface hardness of the center | 59 | 59 | 71 | 71 |
| Cover Composition | | | | |
| Surlyn ® 9945 (wt %) | 60 | 80 | 60 | 80 |
| Suryln ® 8320 (wt %) | 40 | 20 | 40 | 20 |
| Golf Ball Properties | | | | |
| Ball Compression (Atti) | 46 | 48 | 31 | 35 |
| Ball COR | 0.792 | 0.795 | 0.782 | 0.785 |
| Outer Surface Hardness (Shore D) | 56 | 60 | 56 | 60 |

The following polymer, additive, and filler materials were used in the above examples:

Neodene BR 40, commercially available from Karbochem;

Budene® 1207G polybutadiene, commercially available from Goodyear Chemical;

Buna SB 1502 styrene butadiene rubber, commercially available from Goodyear Chemical;

Buna CB 1221, commercially available from Lanxess Corporation;

Dymalink® 526 zinc diacrylate, commercially available from Cray Valley;

Perkadox BC-FF, commercially available from AkzoNobel;

Rhenogran Zn-PCTP-70 zinc pentachlorothiophenol, commercially available from RheinChemie;

Aflux® 16 calcium salts of fatty acids, commercially available from RheinChemie;

Polywate 325 barium sulfate, commercially available from Cimbar Performance Minerals; and Suryln® 8320 very low modulus ethylene/methacrylic acid/acrylate terpolymer (9 wt % acid) in which the acid groups have been partially neutralized with sodium ions; Surlyn® 8940 and Surlyn® 8945 E/MAA copolymers (15 wt % acid) in which the acid groups have been partially neutralized with sodium ions; and Surlyn® 9945 E/MAA copolymers (15 wt % acid) in which the acid groups have been partially neutralized with zinc ions, commercially available from E.I. du Pont de Nemours and Company.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A three-layer golf ball consisting essentially of:

a dual core having an overall compression of 30 or less and consisting of:

a center having an SCDI compression of from 80 to 120, a center hardness of from 53 Shore C to 65 Shore C, and formed from a first rubber composition; and an outer core layer having an outer surface hardness of from 55 Shore C to 70 Shore C and formed from a second rubber composition; and a cover layer formed from a thermoplastic composition;

wherein the golf ball has a compression of from 25 to 35; and wherein the cover layer has a Shore D hardness of greater than 58.

2. The three-layer golf ball of claim 1, wherein the cover layer has a Shore D hardness of greater than 60.

3. The three-layer golf ball of claim 1, wherein the center has a positive hardness gradient wherein the center Shore C hardness of the center is at least 10 units less than the interface Shore C hardness of the center.

4. The three-layer golf ball of claim 3, wherein the dual core has a positive, negative, or zero hardness gradient wherein the difference between the center Shore C hardness of the center and the outer surface Shore C hardness of the outer core layer is from 0 to 5.

5. The three-layer golf ball of claim 1, wherein the cover layer composition is formed from a composition comprising a first ionomer and a second ionomer.

6. The three-layer golf ball of claim 5, wherein the first ionomer is a partially neutralized ethylene-methacrylic acid copolymer.

* * * * *